US005493352A

United States Patent [19]

Reddig et al.

[11] Patent Number: 5,493,352

[45] Date of Patent: Feb. 20, 1996

[54] FILM CARTRIDGE MAGAZINE

[75] Inventors: Alan G. Reddig; Thomas C. Merle, both of Rochester; Gerald F. Sherman, Jr., Leroy; Alfonso Ianni, Rochester; Bradley C. DeCook, Rochester; David J. Laurin, Rochester, all of N.Y.

[73] Assignee: Eastman Kodak Company, Rochester, N.Y.

[21] Appl. No.: 242,563

[22] Filed: May 12, 1994

[51] Int. Cl.[6] ..... G03D 13/08

[52] U.S. Cl. ..... 354/340; 354/275

[58] Field of Search ..... 354/319–323, 354/340, 174, 275, 316; 352/123, 78 R; 353/26 A, 26 R; 198/131; 242/587.4; 414/331; 221/69, 74, 75

[56] References Cited

U.S. PATENT DOCUMENTS

| | | | |
|---|---|---|---|
| Re. 26,770 | 1/1970 | Lemelson | 29/33 |
| 1,374,462 | 4/1921 | Miller . | |
| 2,200,681 | 5/1940 | Rollings | 352/123 |
| 2,227,259 | 12/1940 | Hokanson | 352/123 |
| 3,026,764 | 3/1962 | Allen et al. . | |
| 3,164,059 | 1/1965 | Turrentine, Jr. | 352/26 A |
| 3,285,434 | 11/1966 | Landy . | |
| 3,314,556 | 4/1967 | Perrella et al. . | |
| 3,646,258 | 2/1972 | Lemelson | 352/123 X |
| 3,716,128 | 2/1973 | Edge et al. | 198/38 |
| 3,788,450 | 1/1974 | Tschunt | 198/131 |
| 3,860,107 | 1/1975 | Cioni et al. | 198/131 |
| 4,323,097 | 4/1982 | Achen | 198/472 X |
| 4,371,075 | 2/1983 | Erlichman | 198/345 |
| 4,494,456 | 1/1985 | Pink | 198/648 X |
| 4,710,352 | 12/1987 | Slater et al. | 422/63 |
| 4,731,628 | 3/1988 | Uenaka et al. | 352/123 |
| 4,797,698 | 1/1989 | Uenaka et al. | 354/319 |
| 4,831,401 | 5/1989 | Uchiyama et al. | 354/319 |
| 4,843,412 | 6/1989 | Uchiyama et al. | 354/319 X |
| 4,949,106 | 8/1990 | Igarashi | 352/123 |
| 5,029,626 | 5/1991 | Lichti, Sr. et al. | 414/331 |
| 5,032,707 | 7/1991 | Gudmundson et al. | 355/40 X |
| 5,090,863 | 2/1992 | Lichti, Sr. et al. | 414/331 |
| 5,148,198 | 9/1992 | Shiba | 354/319 |
| 5,162,842 | 11/1992 | Shiota | 355/40 |
| 5,176,285 | 1/1993 | Shaw | 221/3 |
| 5,191,693 | 3/1993 | Umetsu | 198/803.14 X |
| 5,197,844 | 3/1993 | Lichti, Sr. et al. | 414/331 |
| 5,212,512 | 5/1993 | Shiota | 354/319 |
| 5,217,688 | 6/1993 | Von Lersner | 422/26 |
| 5,222,625 | 6/1993 | Reinken et al. | 221/113 |
| 5,224,585 | 7/1993 | Blanco et al. | 198/803.01 |
| 5,229,802 | 7/1993 | Shiota | 354/340 |
| 5,231,439 | 7/1993 | Takahashi et al. | 354/321 X |
| 5,238,351 | 8/1993 | Lichti, Sr. et al. | 414/331 |
| 5,325,144 | 6/1994 | Yoshikawa et al. | 354/319 |
| 5,347,338 | 9/1994 | Weibel | 354/340 |

FOREIGN PATENT DOCUMENTS 4346346 12/1982 Japan .

*Primary Examiner*—D. Rutledge
*Attorney, Agent, or Firm*—Peter J. Bilinski

[57] ABSTRACT

A magazine is provided for receiving, containing and dispensing a plurality of film cartridges in a desired sequential order. The magazine includes a disk shaped core and a shell. The core includes a plurality of cavities for receiving the cartridges, while the shell includes first and second spaced panels and supports the core for relative rotation between the panels. The panels cover the cartridges in the cavities, but also include apertures for selectively providing access to individual cavities by controlled rotation of the core in the shell. The cavities are arranged in a spiral in the core, and the apertures are elongate radial slots dimensioned for alignment with one cavity in the spiral after another, but only one cavity at a time.

11 Claims, 3 Drawing Sheets

FILM CARTRIDGE MAGAZINE

CROSS-REFERENCE TO RELATED APPLICATIONS

Reference is made to commonly assigned copending U.S. patent application Ser. No. 08/241,986 (Attorney's Docket No. 65485), Entitled Random Batch Photofinishing, filed on even date herewith in the name of Jack C. DeMarti, Jr. et al., the disclosure of which hereby is incorporated into the present specification.

BACKGROUND OF THE INVENTION

1. Field of Invention

The invention relates to magazines for handling film cartridges in photographic applications, and more specifically to such magazines for receiving, and later dispensing the cartridges in a desired order.

2. Description of Related Art

In a typical photofinishing operation, film rolls are accumulated, sorted and removed from their containing cartridges for processing. The cartridges are cracked open to release the film, and discarded at a very early stage in the operation. During their short life the cartridges are handled in bins, totes and conveyers for isolating batches of film according to the required processing parameters.

Although the film cartridges often do not last long in a processing facility, cartridge magazines have been employed to facilitate their handling. Gudmundson et al. U.S. Pat. No. 5,032,707, issued Jul. 16, 1991, discloses one example that includes a magazine for maintaining sorted film in transportable batches. Their magazine is a rectangular tube open at both ends for receiving film cartridges at one end and dispensing the cartridges in the same sequence from the other end.

Photographic processes have been proposed in which the film is retained in its cartridge throughout the processing operation, or is returned to a similar cartridge after film processing. The cartridges typically are handled by conveyers, or in magazines. One approach is presented in Takahashi et al. U.S. Pat. No. 5,231,439, issued Jul. 27, 1993. Takahashi et al. use rectangular tubes, including escape mechanisms, for containing and dispensing the film cartridges. Another approach is disclosed in Tianello et al. U.S. patent application Ser. No. 08/172,013, entitled Film Cartridge Magazine, filed on Dec. 22, 1993. Tianello et al. use a plurality of cartridge pockets or sleeves arranged in a ring around a hub. Film cartridges are loaded into the pockets in a desired sequential order, and can be dispensed from the pockets, one at a time, in the same or reverse sequential order.

PROBLEM SOLVED BY THE INVENTION

In previous magazines based on rectangular tubes, the cartridges are loosely contained. If the tube is used as a portable container subject to rough handling, the cartridges might jam or turn on end and shuffle their order. Even when the tube remains in a fixed position, the cartridges move in the tube under the influence of gravity. A substantially vertical orientation is required, and it is difficult to locate any particular cartridge relative to the magazine.

In some applications, it may advantageous to dispense the film cartridges from the magazine and then return the cartridges to the same magazine positions. In other applications the magazine may be used at one stage of an operation to maintain the cartridges in a known sequential order, but in other stages a different order may be required. First time development and printing, for example, usually is sequential, while makeovers are not. Many prior magazines, including the tubular examples mentioned above, do not provide the flexibility desired for such diverse applications.

The above mentioned magazine that includes rings of cartridge-receiving pockets has many desirable features for a wide variety of applications. However, the embodiment of a single concentric ring is limited in capacity. Multiple concentric rings require a discontinuous indexing step to jump from one ring to the next. Stacked concentric rings quickly increase the thickness of the magazine and limit random retrieval. Additionally, at least the outermost cartridges are exposed to the environment with little protection.

SUMMARY OF THE INVENTION

The present invention is directed to overcoming one or more of the problems set forth above. Briefly summarized, a film-cartridge magazine is provided for receiving, containing and dispensing a plurality of film cartridges in a desired sequential order. According to one aspect of the invention, the magazine includes a disk shaped core and a shell. The core includes a plurality of cavities for receiving the cartridges, while the shell includes first and second spaced panels and supports the core for relative rotation between the panels. The panels cover the cartridges in the cavities, but also include an aperture for selectively providing access to individual cavities by controlled rotation of the core in the shell. According to more specific features, the cavities are defined by openings passing entirely through the core, apertures in both the first and second panels are aligned on opposite sides of the pockets, and the film cartridges can be inserted and dispensed from the cavities through either panel.

According to another aspect of the invention, the cavities are arranged in a spiral in the core, and the apertures are elongate radial slots dimensioned for alignment with one cavity in the spiral after another, but only one cavity at a time. A more specific feature includes a spiral groove running alongside the cavity spiral for tracking the locations of the cartridges relative to the shell and associated equipment.

The invention provides a compact magazine that facilitates the handling of film cartridges in a forward or reverse sequential order, while also permitting random retrieval when desired. The cartridges are protected from abuse and the environment by a surrounding shell, which serves also, in cooperation with an internal core, to control loading and dispensing of the cartridges by hand or in associated equipment. The cartridges are constrained against movement in a track in the core, and the positions of the cartridges can be determined easily from their position in a track and the rotational position of the core.

The cartridge magazine can be used in any orientation, facilitating its use in a wide variety of equipment, and can receive and dispense cartridges from either side.

These and other features and advantages of the invention will be more clearly understood and appreciated from a review of the following detailed description of the preferred embodiments and appended claims, and by reference to the accompanying drawings.

DESCRIPTION OF THE PREFERRED EMBODIMENTS

Figure 1:
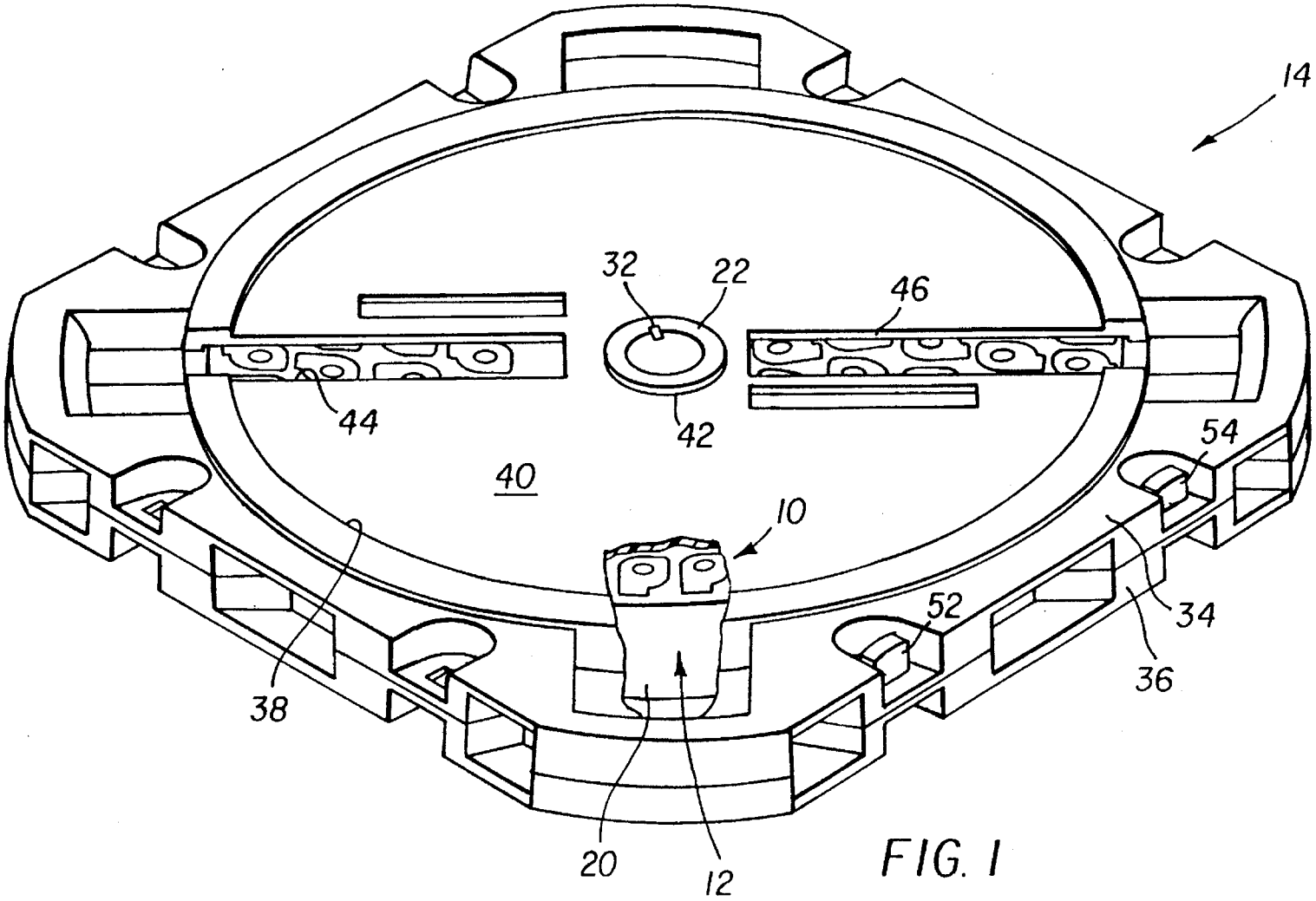
FIG. 1 is a perspective view of a film-cartridge magazine according to a preferred embodiment of the invention, showing the shell and apertures in the shell for providing controlled access to cartridges in the magazine.

Referring now to the drawings, a preferred embodiment of the invention is depicted, including a plurality of film cartridges 10 received in a magazine 11 having a core 12 supported in a shell 14.

The film cartridges are similar to existing thirty five millimeter (35 mm) cartridges, having a non-circular cross section defined by a body portion 16 and a snout 18. The body portion 16 is adapted to contain a roll of photographic film. The snout 18 defines a conduit for movement of the film in both directions between the body portion and the exterior of the cartridge 10.

Figure 2:
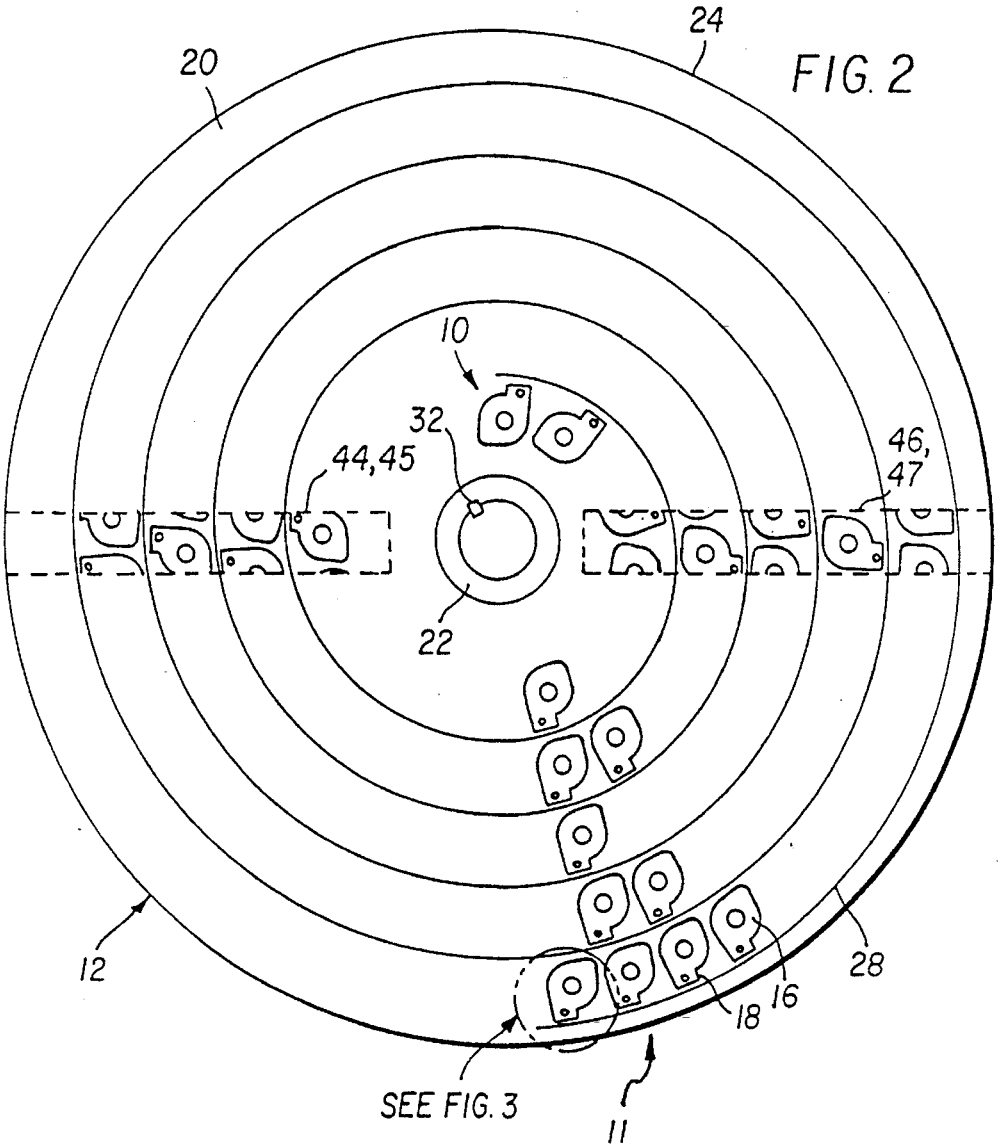
FIG. 2 is a top plan view of the magazine with the cover removed, showing a core having a plurality of cavities arranged in a spiral for containing the cartridges.
Figure 3:
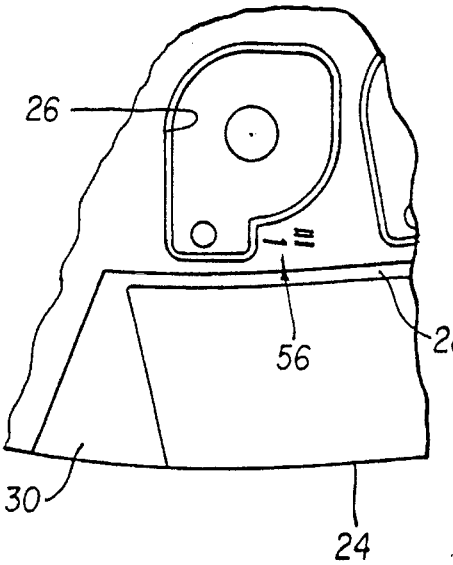
FIG. 3 is a partial view of the core of FIG. 2, enlarged to show a portion of a spiral track running adjacent to the cavities and indicia associated with each cavity.

The core 12 includes a disk 20, including or mounted on an inner hub 22, and extending to an outer periphery 24 (FIG. 2). The disk 20 is approximately the same or slightly greater in thickness than the longitudinal dimension of the cartridges, and is provided with a plurality of cavities 26 (FIG. 3) for receiving the cartridges substantially parallel to the inner hub. The cavities 26 are open at both ends and have essentially an outer uniform but non-circular cross section corresponding to the cross sectional configuration of the cartridges. The cavities define pockets or sleeves that receive or dispense the cartridges from either end of the cavity, but only in one predetermined orientation preferably relative to the core 12. The cavities are closely spaced in a continuous spiral pattern beginning at one end near the outer periphery 24, and spiraling inward through several convolutions to the other end near hub 22. In the embodiment illustrated, approximately one hundred and twenty (120) cavities are provided for the efficient use of photofinishing equipment. The number of cavities may be varied as desired so as to meet or compliment the requirements of the photofinishing equipment. The spiral pattern is designed so that the pitching between adjacent cavity is such that only one cavity will be fully disclosed at the dispensing slot so that only one cartridge can be removed or inserted from the magazine at one time.

The core 12 also includes, on one or both sides, a spiral tracking groove 28 that has a radial entrance 30 and then runs adjacent the cavities in a similar spiral. The track is adapted for receiving a follower in associated equipment for determining the rotational position of the cavity spiral. The cartridge magazine 11 is particularly well suited for handling film cartridges in a sequential order, one cartridge after another, and the spiral groove 28 facilitates such sequential handling.

The hub 22 is adapted for mounting the core 12 in either direction on a drive spindle (not shown) of associated equipment. A spline or key 32 both defines a home position of the core on the equipment and serves for rotating the core 12 through the spindle. Using the home position allows locating any one particular cavity 26 so desired and thus allow locating of any particular cartridge placed within that cavity. This also allows for the random selection of cartridges in any order so desired or that may be required due to modifications and changing conditions of the photofinishing process.

The shell 14 includes two similar halves 34 and 36 that combine to cover and protect the core. Each half has a dished recess at 38 to accommodate approximately half the thickness of the core 12. The two recesses 38 define opposed spaced panels 40 that rotatably receive the core 12 therebetween, covering the cavities 26. A circular central aperture 42 accommodates and provides access to the core hub 22, again from either side. The shell 14 also includes pairs of opposed apertures, preferably elongate radial slots 44,45 and 46,47 (the same in both of the opposed panels 40), that provide access to the cavities 26 from either side when the shell 14 is closed. The slots are slightly wider than the cavities, 26 and are configured with the spiral so only one cavity at a time is completely aligned with either slot pair. The core 12 starts in a home position in which none of the cavities are aligned with the slot. The core 12 is then rotated relative to the shell into a starting position aligned with the first cartridge of interest, and is indexed one cavity at a time progressing around the spiral from the beginning to the end.

The magazine 11 is assembled by snapping the core 12 into position in one half of the shell, and then the shell halves are combined and secured together with appropriate releasable fasteners 52 and 54. Although the shell halves are not intended to be opened during normal use, they can be separated from each other without releasing the core 12 from the shell half in which it was first assembled. This prevents accidental release, and controls full access to the core always from the same side. It is to be understood that the shell halves 34 and 36 and core 12 may be assembled together in any desired manner.

In the embodiment illustrated, the exterior of the shell is provided with shapes that define keying features symmetrical on all four edges to facilitate a wide variety of magazine positions in associated equipment. The cartridge position can be selected to locate the film with its emulsion side up or down, and to permit loading and unloading from either side of the magazine..The shell panels are preferably transparent to permit viewing of the cartridges and the cartridge identification numbers through the panels 40, and the magazine itself includes a bar code or other machine readable indicia for identifying the magazine batch.

Inside the shell, each cavity 26 also can be provided with a unique mark in a predetermined position, both for visual and machine identification of the cavity, and for establishing the location of each cavity relative to the mark. Indexing from one cavity to the next can use the unique marks, the rotational position of the core and or a machine follower in track 28.

In the particular embodiment illustrated, a plurality of recesses 56 are provided, preferably one in each of the four corners. The recesses 56 can be used for orienting and holding the magazine in the photofinishing equipment. Additionally, one of the recesses 56 can be configured so as to form a handle or carrying of the magazine.

In the particular embodiment illustrated, shell halves 34 and 36 are used for maintaining the cartridges 10 within the magazine 11, however, the present invention is not so limited. If desired, the core 12 may be provided with other retaining means for holding the film cartridge within each of the cavities 26. For example, but not by way of limitations, each of the cavities may be provided with a spring loaded detent member for holding of the cartridge within the cavity.

The cavity may be provided with a slightly enlarged area, which conforms to the shape of the cartridge, so that the cartridge may seat within the cavity 26 at a predetermined position.

Figure 4:
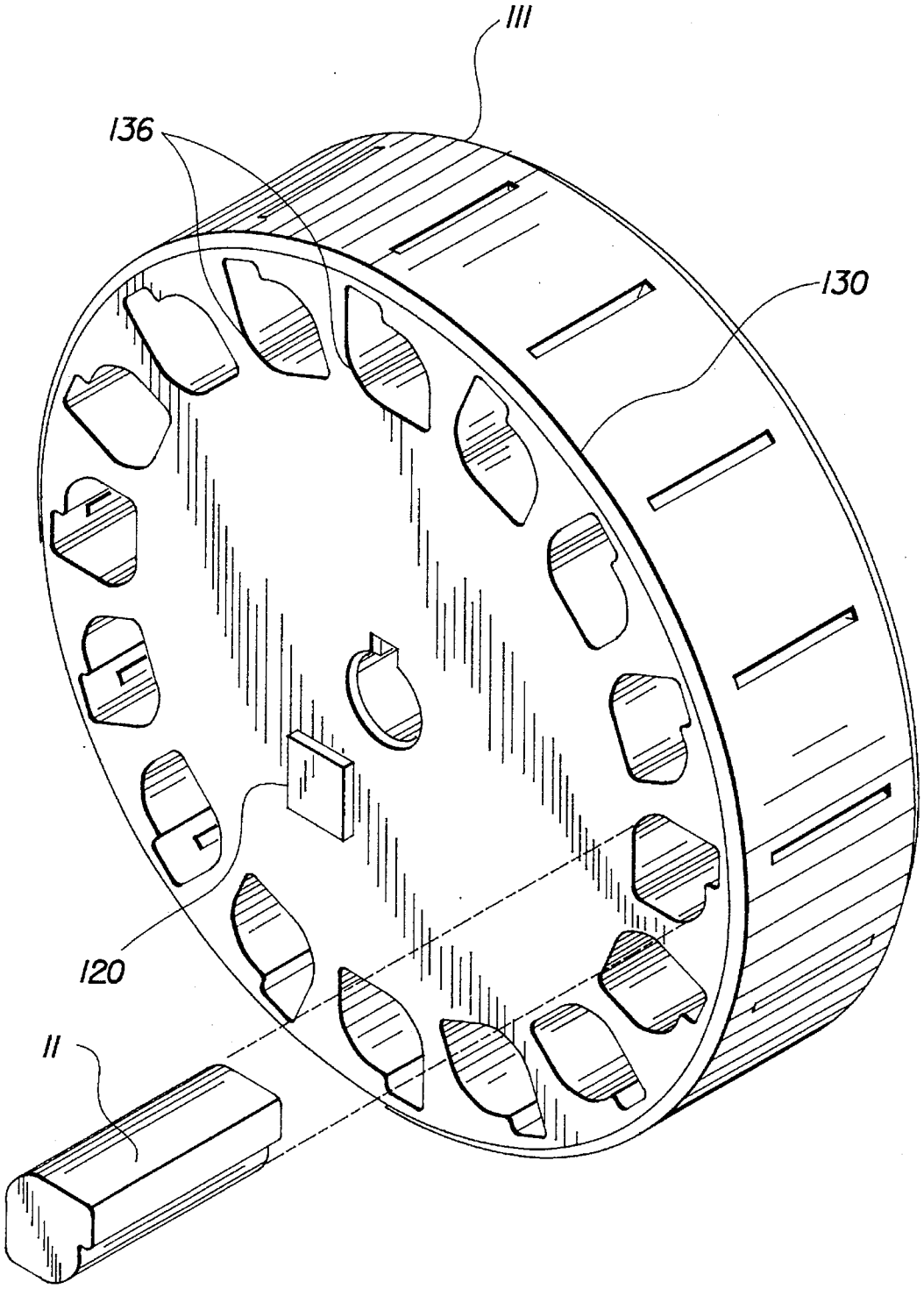
FIG. 4 is a perspective view of a modified magazine made in accordance with the present invention.

Referring to FIG. 4, there is illustrated a modified magazine 111 also made in accordance with the present invention. In this embodiment, a non-volatile memory 120 is provided for identifying cartridges placed within the cavities and for locating the home position of the core. In this particular embodiment, magazine 111 comprises a core 130 having a plurality of cavities disposed adjacent the periphery. A plurality of openings 136 are provided, one associated with each of the cavities, for allowing a filmstrip disposed within the cartridge to be dispensed (thrust) from the cartridge 11 while the cartridge is still within the cavity. The memory 120 serves not only to identify and locate a cartridge located within the magazine, but also serves to provide means for determining the home position of a magazine so that each of the cavities can be easily and quickly located with respect to manual or automatic dispensing or insertion in the appropriate film cartridge. A more detailed description of a magazine having a nonvolatile memory is described in coassigned patent application, filed concurrently with application, entitled "SMART FILM CARTRIDGE MAGAZINE", by Bradley DeCook, Brian Gallipeau and David D'Aurelio, Ser. No. 08/241,884 which is hereby incorporated by reference.

While the invention is described in connection with a preferred embodiment, other modifications and applications will occur to those skilled in the art. The claims should be interpreted to fairly cover all such modifications and applications within the true spirit and scope of the invention.

PARTS LIST FOR FIGS. 1–4

Reference No. Part
10—Film cartridges.
11—Magazine.
12—Core.
14—Shell.
16—Body portion.
18—Snout.
20—Disk.
22—Inner hub.
24—Outer periphery.
26—Cavities.
28—Tracking groove.
30—Radial entrance.
32—Key.
34—Shell half.
36—Shell half.
38—Dished recess.
40—Panel.
42—Aperture.
44—Slot.
45—Slot.
46—Slot.
47—Slot.
52—Fastener.
54—Fastener.
56—Recesses.
111—Modified Magazine.
120—Memory.
130—Core.
136—Openings.

What is claimed is:

1. A magazine for containing a plurality of film cartridges, said magazine comprising:

a disk including a plurality of cavities, each sized for receiving at least one of the cartridges;

a shell including first and second spaced panels for supporting said disk for relative rotation between said panels, said panels including a first aperture which is selectively positionable in alignment with at least one of said cavities by relative rotation between said disk and said panels wherein said cavities are defined by openings passing entirely through said disk, in which said first aperture is provided in said first panel, and said second panel includes means defining a second aperture which is selectively positionable in alignment with at least one of said cavities by relative rotation between said disk and said second panel.

2. The invention of claim 1, wherein said disk and said panels define an axis of relative rotation, in which said first aperture and second aperture are aligned parallel to the axis of relative rotation, and said first aperture and second aperture permit loading of said cavities through either of said first and second panels.

3. The invention of claim 1, wherein said cavities are arranged in a spiral pattern in said disk, said first aperture is an elongate radial slot, and said cavities and said slot have approximately the same dimension in a direction substantially normal to said slot.

4. The invention of claim 3, wherein said spiral pattern and said slot are configured selectively to align only one cavity at a time with said slot.

5. A magazine for containing a plurality of film cartridges comprising:

a disk including openings passing entirely through said disk, said openings defining a plurality of cavities for receiving and dispensing at least one of the cartridges from either side of the disk and for containing the cartridges in said cavities;

a shell enclosing said disk, said shell including first and second panels for supporting said disk for rotation between said panels, said panels including means defining opposed apertures alignable with said cavities by rotation of said disk, thereby providing access to said cavities through either of said first and second panels.

6. The invention of claim 5, wherein said opposed apertures are substantially identical first and second slots in said first and second panels, respectively, said first and second slots having one dimension approximately the same as a corresponding dimension of said cavities.

7. The invention of claim 6, wherein said cavities are arranged in a spiral pattern in said disk.

8. The invention of claim 7, wherein said disk includes a spiral groove running alongside said cavities.

9. A magazine for containing a plurality of film cartridges, comprising;

a disk defining a plurality of cavities for receiving the cartridges, said cavities arranged in a continuous spiral defining a sequence;

a shell supporting said core for rotation relative to said shell, said shell covering said cavities to contain the cartridges in said cavities, said shell including aperture means for selectively providing access to release cartridges only one-at-a-time from said cavities, either forward or backward according to said spiral sequence wherein said aperture means is a radial slot having a width dimension approximately the same as a corresponding cavity dimension.

10. A magazine for containing a plurality of film cartridges, comprising:

a support member having a plurality of cavities for receiving and dispensing at least one film cartridge, said cavities having a pair of open ends; and retaining members associated with each of the cavities for holding said film cartridges within the cavity, said retaining means allowing the cartridges to be easily dispensed as required; and, in which an opening is associated with each of said cavities for allowing a filmstrip to be thrust from a film cartridge while within the cavity.

11. The invention of claim 10, wherein said cavities are arranged on said support member in a spiral pattern.

* * * * *